US007032887B2

(12) United States Patent
Mert et al.

(10) Patent No.: US 7,032,887 B2
(45) Date of Patent: Apr. 25, 2006

(54) CABLE WINCH ARRANGEMENT AND METHOD FOR THE OPERATION THEREOF

(75) Inventors: Hubert Mert, Schrobenhausen (DE); Lothar Herbert Schirmel, Lippertshofen (DE)

(73) Assignee: Bauer Maschinen GmbH, Schrobenhausen (DE)

( * ) Notice: Subject to any disclaimer, the term of this patent is extended or adjusted under 35 U.S.C. 154(b) by 0 days.

(21) Appl. No.: 10/838,301

(22) Filed: May 5, 2004

(65) Prior Publication Data

US 2004/0232398 A1 Nov. 25, 2004

(30) Foreign Application Priority Data

May 9, 2003 (DE) ..... 103 20 946

(51) Int. Cl.
*B66D 1/10* (2006.01)

(52) U.S. Cl. ..... 254/361; 254/360

(58) Field of Classification Search ..... 254/360, 254/361, 377

See application file for complete search history.

(56) References Cited

U.S. PATENT DOCUMENTS 6,382,595 B1 * 5/2002 Nold, III ..... 254/361
6,439,544 B1 * 8/2002 Rosenberg ..... 254/334

FOREIGN PATENT DOCUMENTS

| | | | |
|---|---|---|---|
| DE | 36 43 114 C2 | | 6/1995 |
| DE | 100 06 407 A1 | | 8/2001 |
| DE | 101 16 342 A1 | | 10/2002 |
| EP | 196445 A | * | 10/1986 |
| EP | 236732 A | * | 9/1987 |

* cited by examiner

*Primary Examiner*—Emmanuel M Marcelo
(74) *Attorney, Agent, or Firm*—Jacobson Holman PLLC

(57) ABSTRACT

The invention relates to a cable winch arrangement with a cable winch, a winch drive and a control device, as well as to a method for the operation thereof. The control device makes it possible to connect in a first operating mode for raising and lowering and a second operating mode in which it is possible to set a superimposed load on a cable of the winch.

16 Claims, 1 Drawing Sheet

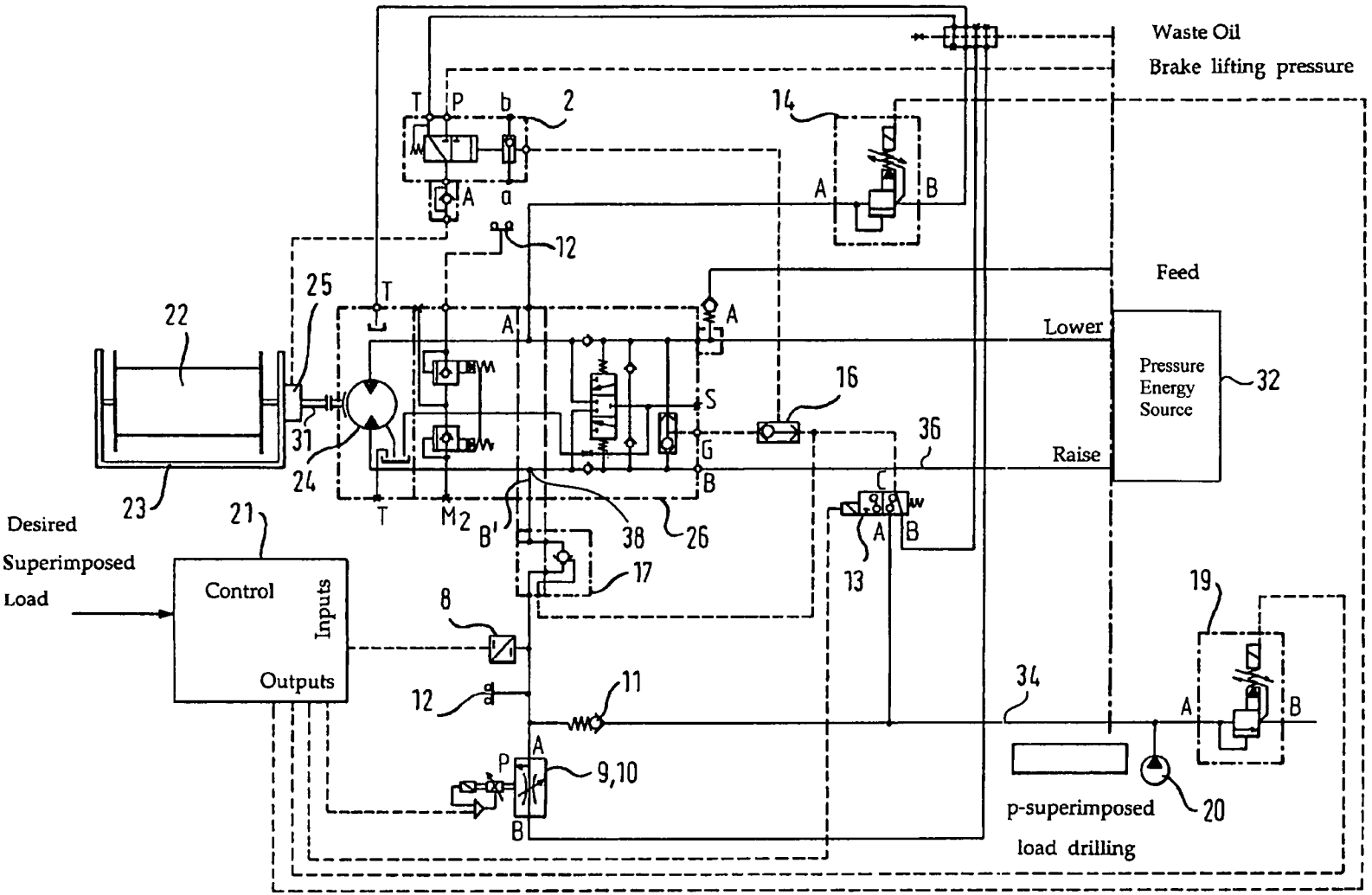
Waste Oil
Brake lifting pressure
Feed
Pressure Energy Source
Lower
Raise
p-superimposed load drilling
Inputs
Control
Outputs
Desired Superimposed Load

CABLE WINCH ARRANGEMENT AND METHOD FOR THE OPERATION THEREOF

BACKGROUND OF THE INVENTION

The invention relates to on the one hand a cable winch arrangement with a cable winch, a winch drive and a control device and on the other to a method for the operation thereof.

Such cable winch arrangements are more particularly used in special underground construction engineering. Such winches are e.g. used for raising and lowering so-called pile drilling tools with which it is possible to drill holes or bores with a drilling depth of approximately 100 m and diameters drilled of approximately 1 to 3 m. As a result of the large diameter drilled, in the case of pile drilling the total weight of the drilling line and possibly an additional contact pressure is used as the superimposed load for the drilling tool.

So-called well boring or drilling differs from pile drilling and the necessary well drilling equipment has a much smaller drilling diameter of approximately max. 300 mm to 500 mm. However, the drilling depths needed range from several 100 m to approximately 1000 m. As a result of the small diameter drilled and the greater drilling depths, the superimposed load on the drill head produced by the drilling line weight would be excessive, so that damage thereto could arise. To prevent this, the superimposed load must be reduced in precisely controlled manner by means of the winch carrying the drilling line. Such a superimposed load control procedure is normally brought about by using special winches having two drive motors, such as is e.g. known from DE 41 34 742 C1.

SUMMARY OF THE INVENTION

The object of the invention is to provide a cable winch arrangement and a method for the operation thereof with which it is possible in the case of a simple construction to bring about a reliable superimposed load control.

The cable winch arrangement according to the invention is characterized in that through the control device it is possible to connect in a first operating mode for raising and lowering and a second operating mode in which a superimposed load can be adjusted on a cable winch.

A fundamental idea of the invention is to provide a control with two operating modes. The control is constructed with a first operating mode designed for normal raising and lowering operation. During such operation and without a complicated control, it is possible for a rapid, efficient raising and lowering to take place, such as is e.g. adequate for pile drilling. However, according to the invention the control can also be switched to a second operating mode in which, by means of an input possibility of the control, it is possible to set a desired, reduced superimposed load and the control device by means of corresponding control members correspondingly controls and monitors the winch drive. The control can also incorporate regulation of the winch drive. The cable winch arrangement design according to the invention in this way also permits use for well drilling without two drives having to be provided, as is the case in the prior art.

According to a preferred embodiment of the invention, the winch drive has a hydraulic motor, which is connected by means of hydraulic lines to a pressure energy source. In the case of a compact arrangement, a hydraulic motor permits a high force transmission.

According to the invention, a particularly robust, reliable control arrangement is brought about by providing controllable valves, which are controllable by means of the control device.

A measurement of the superimposed load on the cable, such as is e.g. necessary for well drilling, can be reliably and simply achieved according to the invention in that the hydraulic lines incorporate at least one pressure gauge for measuring hydraulic pressure, the pressure gauge being connected to the control device. According to the invention the pressure in the hydraulic line is correlated with the superimposed load and can consequently be used by means of correspondingly taking account of a correlation rule in the control device for the determination, control or regulation of the desired superimposed load on the drilling equipment.

In order to increase the operational safety of the cable winch arrangement according to the invention, on the cable winch is constructed a hydraulically operable blocking brake, which is controllable by means of the control device.

The method for operating a cable winch arrangement according to the invention is characterized in that for raising and lowering a first operating mode is connected in the control device and that a second operating mode is connected in which a superimposed load is set on a cable of the winch. As a result of this method it is possible to achieve the aforementioned advantages when operating the cable winch arrangement according to the invention.

BRIEF DESCRIPTION OF THE DRAWINGS

The invention is described in greater detail hereinafter relative to a preferred embodiment, which is diagrammatically shown in the lone hydraulic circuit diagram.

DETAILED DESCRIPTION OF THE INVENTION

The cable winch arrangement according to the invention comprises a drum-shaped cable winch 22, which is rotatably mounted in a holder 23 and can be driven by a diagrammatically represented drive shaft 31 using a winch drive 24. The cable winch 22 can be fixed by means of a blocking brake 25, which acts on the drive shaft. The winch drive 24 constructed as the sole hydraulic motor is connected by means of a subsequently explained hydraulic line arrangement to at least one pressure energy source 20 in the form of a hydraulic pump via hydraulic line 34.

The hydraulic line arrangement comprises a plurality of valves, which are controllable by means of a control device 21 for setting the two subsequently described operating modes.

First Operating Mode for Feed Winch

This first operating mode is e.g. used for the standard method with dry rotary drilling equipment.

The control device 21 connects the valves in the following way: valve 19 pressureless, valve 13 connection A blocked. Thus, no pressure is applied to the valves 17 and 16 (and consequently 2). The proportional flow regulating valve 9, 10 is also closed in this operating mode. Valve 14 is connected to high pressure. Thus, the pressure energy source 20 constructed as a constant pump delivers the volume flow directly via valve 19 to a tank (not shown). As the second safety stage alongside the valve 17, check valve 11 prevents oil flowing out of the winch control 26 via line B'. Thus, only the normal winch mode and not the superimposed load control is active. For this purpose the pressure energy can be made available by a further, not shown pressure energy source 32 connected to hydraulic line 36 which meets with hydraulic line 34 via check valve 17 at meeting point 38 on line B'.

On now providing pressure for "raising" or "lowering", by means of the changeover valve in the winch control block 26 and the changeover valve 16, valve 2 is operated and therefore the blocking brake 25 is released. The blocking valve in the winch control block 26 is also opened, but only to the extent that the winch drive 24 can wind up or unwind in controlled manner the cable winch 22.

Second Operating Mode for Superimposed Load Control

This operating mode is e.g. used if the drilling equipment is used with flush or wash boring or drilling means, e.g. for well drilling.

Valve 19 is switched over, so that the pressure energy source 20 can produce high pressure. Valve 14 is switched over to low pressure. This pressure setting is higher than the feed pressure, so that via valve 14 no oil can flow out of the feed circuit. Valve 9, 10 is closed. Valve 13 can now be reversed in order to open check valve 17 and the blocking brake 25 with the aid of valve 2. Switching over of valve 13 is only released when the pressure switch 12 indicates an adequately high pressure.

After releasing the blocking brake 25, the cable winch 22 is wound up at low speed, because the volume flow is supplied by the pressure energy source 20. The pressure gauge 8 can now detect the pressure necessary for raising the suspended flush drilling line. In order to calculate the load on the winch (in this state corresponds to the drilling line weight) by means of the pressure, account must be taken of the initial load produced by the valve 14.

The control now slowly opens valve 9, 10, so that the volume flow can flow out. If a greater volume flow flows out than is delivered by the pump 20, the cable winch 22 starts to unwind. Thus, in this operating mode it is possible to have a cable unwinding from the cable winch 22 with a predetermined superimposed load and with the same winch drive 24 as can be used in normal winch operation.

When the drilling line is lowered to the bottom, the superimposed load on the drill head rises. The control ensures that the set superimposed load is not exceeded.

Through the continuous pressure measurement at gauge 8, in the case of falling pressure and therefore excessive superimposed load, the control can somewhat close the flow regulating valve 9, 10 in order to once again obtain the predetermined superimposed load. With rising pressure at the pressure gauge 8 and therefore inadequate superimposed load, the flow regulating valve 9, 10 is correspondingly opened by the control device 21.

Thus, if the superimposed load is excessive, the inventive control does not lower the drilling line as rapidly as the drilling progress or advance, or may even raise the same. If the detected superimposed load is inadequate, the drilling line is once again more rapidly lowered by the cable winch 22, so that it is more strongly supported on the bottom.

At the end of drilling, there is a switch once again into the first operating mode for drawing out the drilling line.

What is claimed is:

1. A cable winch arrangement comprising:

a cable winch having a cable;

a winch drive having a hydraulic motor operatively connected to the cable winch;

a first pressure energy source connected to said hydraulic motor via a first hydraulic line;

a valve provided in said first hydraulic line;

a control device for controlling said valve in dependence on measured hydraulic pressure, by means of which a first operating mode is set for raising and lowering said cable winch and by means of which a variable volume flow can be discharged from said first hydraulic line for setting a superimposed load in said second operating mode in which the superimposed load is set on said cable of said cable winch; and a pressure gauge provided in said first hydraulic line for measuring hydraulic pressure correlated with said superimposed load, said pressure gauge being connected with said control device to provide said measured hydraulic pressure.

2. The cable winch arrangement according to claim 1, wherein said valve is a flow regulating valve.

3. The cable winch arrangement according to claim 2, wherein said flow regulating valve is a proportional flow regulating valve.

4. The cable winch arrangement according to claim 1, wherein a second pressure energy source is provided to supply said hydraulic motor in said first operating mode.

5. The cable winch arrangement according to claim 4, wherein said further energy source is connected with said hydraulic motor via a second hydraulic line that connects at a meeting point with said first hydraulic line.

6. The cable winch arrangement according to claim 5, further comprising:

a second valve provided in said first hydraulic line between said meeting point and said first pressure source, said second valve when opened for providing a fluid connection between said first pressure source and said hydraulic motor in said second operating mode.

7. The cable winch arrangement according to claim 6, wherein said second valve is a pilot operated check valve.

8. The cable winch arrangement according to claim 1, further comprising:

a hydraulically operable blocking brake on said cable winch, said brake being controllable by means of said control device.

9. The cable winch arrangement according to claim 1, wherein a third operating hydraulic line is provided at said hydraulic motor.

10. The cable winch arrangement according to claim 9, further comprising:

a feed line meeting said third operating hydraulic line for feeding hydraulic oil in said second operating mode.

11. The cable winch arrangement according to claim 10, wherein said feed line meets said further operating hydraulic line via a second check valve.

12. The cable winch arrangement according to claim 10, further comprising:

a discharge line meeting said further operating hydraulic line, in which discharge line is provided a pressure valve that is in connection with said control device.

13. The cable winch arrangement according to claim 12, wherein said pressure valve is a pressure limiting valve.

14. A method for operating a cable winch arrangement comprising the steps of:

providing a cable winch having a cable;

connecting the cable winch to a hydraulic motor forming part of a winch drive;

providing a control device;

operating the control device in two modes, a first mode for raising and lowering the winch, and a second mode for setting a superimposed load on the cable of the cable winch;

connecting a first pressure energy source to the control device via a first hydraulic line;

in at least said second operating mode, measuring a pressure correlated with the superimposed load in said first hydraulic line, and in said second operating mode, discharging a variable volume flow from the first hydraulic line by a valve controllable by the control device in dependence on said pressure in order to set the superimposed load.

15. The method according to claim 14, further comprising the steps of;

providing a blocking brake for braking and fixing said cable winch; and controlling said blocking brake by said control device.

16. The method according to claim 14, wherein in said second operating mode said valve is first closed and a pressure is measured by a pressure gauge; and the measured pressure is correlated with the weight of a drilling line.

* * * * *